US007137212B2

(12) United States Patent
Miller et al.

(10) Patent No.: US 7,137,212 B2
(45) Date of Patent: Nov. 21, 2006

(54) EXPANDABLE SHOE AND SHOE ASSEMBLIES

(75) Inventors: Harry Miller, Weston, MA (US); Byong M. Shin, Kyungnam (KR); Kwong Dong Chil, Pusan (KR)

(73) Assignee: Inchworm, Inc., Boston, MA (US)

( * ) Notice: Subject to any disclaimer, the term of this patent is extended or adjusted under 35 U.S.C. 154(b) by 0 days.

(21) Appl. No.: 10/846,747

(22) Filed: May 14, 2004

(65) Prior Publication Data

US 2004/0211090 A1 Oct. 28, 2004

Related U.S. Application Data

(60) Division of application No. 10/228,758, filed on Aug. 26, 2002, now Pat. No. 6,807,754, which is a continuation-in-part of application No. 09/950,109, filed on Sep. 10, 2001, now Pat. No. 6,574,888, which is a continuation of application No. 09/438,935, filed on Nov. 12, 1999, now Pat. No. 6,438,872.

(51) Int. Cl.

| | |
|---|---|
| ***A43B 3/26*** | (2006.01) |
| ***A43B 7/14*** | (2006.01) |
| ***A43B 3/28*** | (2006.01) |
| ***A43B 3/30*** | (2006.01) |
| *A43B 1/10* | (2006.01) |

(52) U.S. Cl. ..... 36/97; 36/93; 36/112

(58) Field of Classification Search ..... 36/97, 36/88, 93, 102, 8.4, 112
See application file for complete search history.

(56) References Cited

U.S. PATENT DOCUMENTS

| | | | | | |
|---|---|---|---|---|---|
| 4,120,103 | A * | 10/1978 | Colby | 36/97 |
| 4,178,925 | A * | 12/1979 | Hirt | 36/97 |
| 5,682,687 | A * | 11/1997 | Arai | 36/97 |
| 5,794,362 | A * | 8/1998 | Polk et al. | 36/97 |
| 5,970,632 | A * | 10/1999 | Watson | 36/97 |
| 6,402,163 | B1 * | 6/2002 | Pratt | 36/97 |
| 6,718,658 | B1 * | 4/2004 | Karasawa | 36/97 |
| 2004/0107604 | A1 * | 6/2004 | Ha | 36/97 |
| 2004/0107605 | A1 * | 6/2004 | Caeran et al. | 36/97 |

* cited by examiner

*Primary Examiner*—Anthony Stashick
(74) *Attorney, Agent, or Firm*—Black Lowe & Graham, PLLC

(57) ABSTRACT

An improved expandable shoe and inner assembly are disclosed. The expandable shoe includes an outer shell and an adjustable inner assembly is disposed within the outer shell. The inner assembly has a first board portion and a second board portion in overlapping engagement with each other and a control to adjust the position of the first board portion relative to the second board portion. One of the board portions has a longitudinal projection which extends into a corresponding cavity in the sole of the shoe.

21 Claims, 19 Drawing Sheets

EXPANDABLE SHOE AND SHOE ASSEMBLIES

RELATED APPLICATIONS

This application is a divisional of U.S. patent application Ser. No. 10/228,758 which issued as U.S. Pat. No. 6,807,754 on Oct. 26, 2004, which was filed on Aug. 26, 2002, which is a continuation in part of related U.S. patent application Ser. No. 09/950,109, which issued as U.S. Pat. No. 6,574,888 on Jun. 10, 2003, which is a continuation in part of U.S. patent application Ser. No. 09/438,935, which issued as U.S. Pat. No. 6,438,872 on Aug. 27, 2002, both of which issued patents are hereby incorporated by reference in their entirety.

BACKGROUND OF THE INVENTION

1. Technical Field

The present invention relates to expandable shoes that may be adjusted longitudinally.

2. Discussion of Related Art

Some attempts have been made to provide expandable shoes, which can purportedly withstand day-to-day use. U.S. Pat. No. 3,389,481, for example, discloses a shoe in which a two plate assembly is disposed between an inner and a disjointed outer sole, having overlapping front and back portions. One of the plates includes a spring tongue, and the other plate includes two apertures to receive the spring tongue, each aperture corresponding to a shoe size. To adjust the shoe size, a screw which extends through the heel and into the disjointed soles is removed. The shoe may then be pulled apart allowing the disjointed sole to separate until the spring tongue engages the next aperture. Thus the shoe size may be lengthened by one size, but apparently the size cannot be controlled finely or reduced. The shoe includes two crinkled leather portions 34, one on each side of the shoe, to facilitate expansion of the shoe.

WO 01/33986 describes an expandable shoe. The expandable shoe includes an outer shell having a front and a rear outer assembly each attached to a flexible, expandable segment. An adjustable inner assembly is disposed within the outer shell and includes a control mechanism, accessible from the outer shell, that may be urged from a lock state into a state in which the inner assembly and outer shell may be adjusted. A visualization window provides a view port to the inner assembly.

Though WO 01/33986 details a desirable expandable shoe design, certain improvements thereto have been discovered to improve ergonomics, torsional rigidity, handling, and the construction of the shoe.

SUMMARY

Under one aspect of the invention, an expandable shoe is provided which includes a front outer assembly, and a rear outer assembly. An expandable segment attaches to the front and rear outer assemblies to define a shoe outer shell and the expandable segment extends at least partially along each side of the outer shell and transversely across the bottom of the outer shell. An adjustable inner assembly is disposed within the outer shell and has a first board portion and a second board portion in overlapping engagement with each other. The inner assembly also includes a control to adjust the position of the first board portion relative to the second board portion and to thereby adjust a dimension of the inner assembly and thereby a corresponding dimension of the shoe.

Under another aspect of the invention, the control includes a locking mechanism shaped to engage and hold one of the first and second board portions, a biasing mechanism to bias the locking mechanism into engagement with one of the first and second board portions; and an urging member having a proximal portion external of the shoe outer shell and positioned and movable transversely to a longitudinal direction of the shoe and in transverse alignment with the locking mechanism.

Under another aspect of the invention, one of the first and second board portions include transversely extending teeth, and the locking mechanism includes transversely extending teeth and the urging member include a rod portion having at least two diameters. The locking mechanism includes an aperture in alignment with the rod portion and the cross section of the aperture is larger than the smaller of the at least two diameters but smaller than the large of the at least two diameters. When the urging member is moved, the rod portion contacts and moves the locking mechanism with the larger of the two diameters.

Under another aspect of the invention, one of the first and second board portions includes an upward-facing cavity containing the control. The opening to the cavity is covered by the other of the first and second board portions when the first and second board portions overlap.

Under another aspect of the invention, one of the first and second board portions includes at least one groove extending longitudinally and the other of the first and second board portions includes a corresponding rail in alignment with the groove. The rail is positioned within the groove as the first and second board portions overlap.

Under another aspect of the invention, one of the first and second board portions has at least one projection which extends into a cavity in the sole.

Under another aspect of the invention, at least one of the first and second board portions includes a lattice support structure.

Under another aspect of the invention, one of the first and second board portions includes a set of notches and the locking mechanism has a surface feature to contact a notch in the set of notches to resist relative movement of the first and second members in relation to shoe size and provide ergonomic sensation.

Under another aspect of the invention, a visualization window provides a view to the inner assembly. The inner assembly may include size markings or other indicia representative of a shoe adjustment, and these markings may be placed on the inner assembly to allow them to be visible through the visualization window.

Under another aspect of the invention, a light source may be provided in the cavity to illuminate the visualization window.

DETAILED DESCRIPTION

Certain embodiments of the present invention provide improvements to the ergonomics, torsional rigidity, handling, and construction of the shoe designs disclosed in WO 01/33986. That reference in conjunction with U.S. patent application Ser. No. 09/438,935 is hereby incorporated by reference in its entirety.

Figure 1:
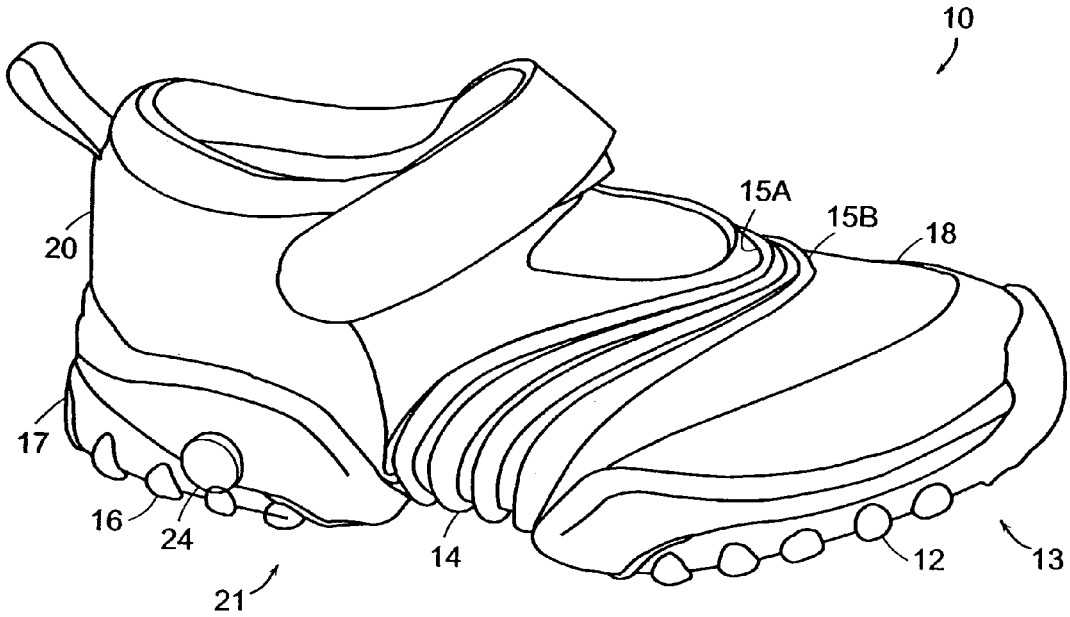
FIGS. 1 and 2 show shoe designs according to certain embodiments of the invention.
Figure 2:
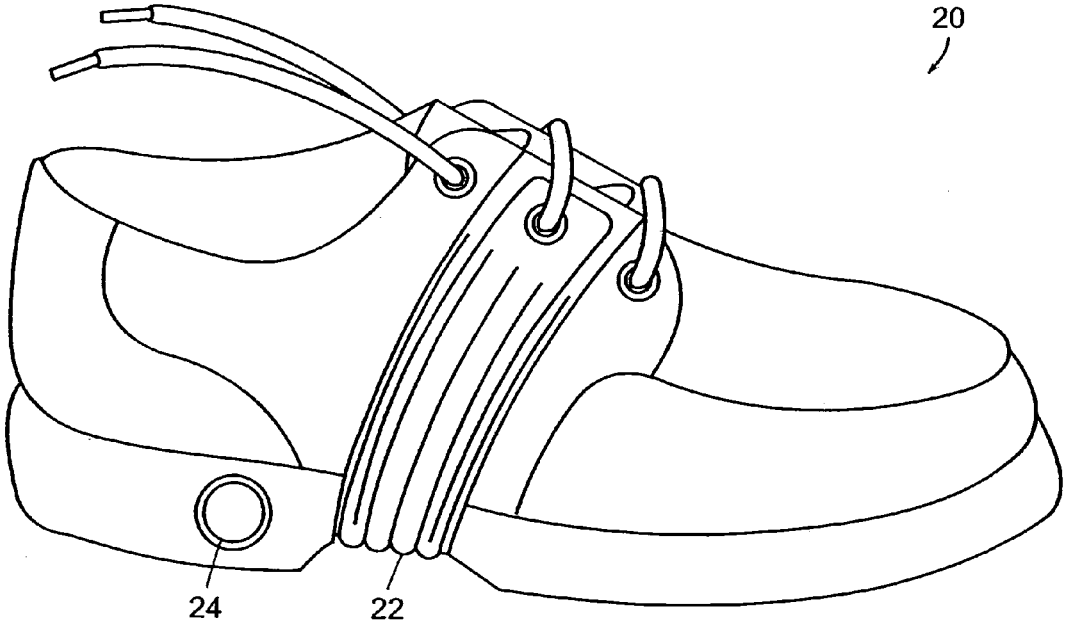

FIGS. 1 and 2 show two shoe designs under certain embodiments of the invention. With reference to FIG. 1, shoe 10 includes a front outer sole 12 and a front upper 18 to form a front outer assembly 13, and a rear outer sole 16 and a rear upper 20 to form a rear outer assembly 17. The front outer assembly 13 is attached to one edge 15B of a bellows segment 14, and the rear outer assembly 17 is attached to a second edge 15A, in each case using conventional techniques, such as by using stitching to the uppers 18, 20 and glue along the outer soles 12, 16. The combination of front outer assembly 13, rear outer assembly 17, and bellows segment 14 forms an outer shell 21.

An alternative shoe 20 is illustrated in FIG. 2. One principal difference in shoe 20 relative to shoe 10 is the bellows 22 of shoe 20 does not completely surround the shoe, whereas bellows 14 of shoe 10 is a unitary bellows enveloping the circumference of the shoe.

Similarly to that described in U.S. patent application Ser. No. 09/438,935, an adjustable inner sole assembly is placed within outer shell 21. An externally-accessible manual control is urged via cap 24 and is used to place the inner sole assembly in a state in which it may be adjusted. When the control is in its natural state (i.e., when it is not urged transversely) it is in a lock state to hold the shoe adjustment fixed.

Figure 3:
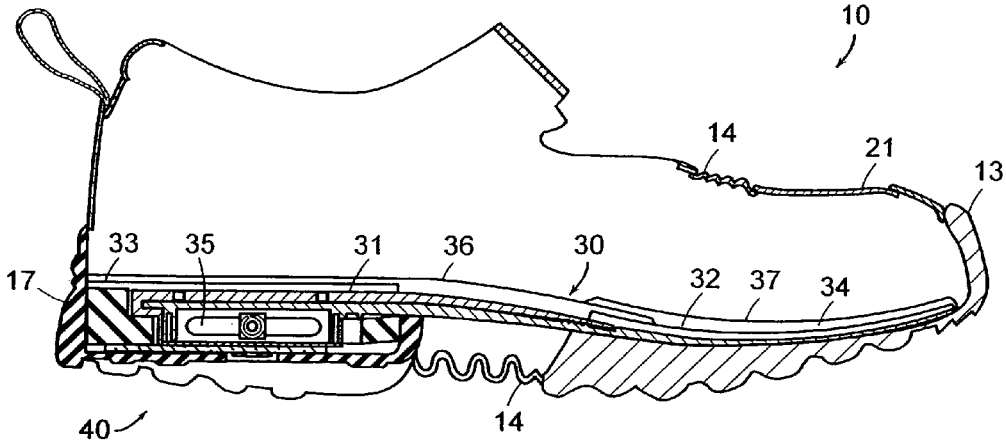
FIG. 3 is a longitudinal cross sectional view of a shoe according to certain embodiments of the invention.

FIG. 3 is a longitudinal cross-sectional view of an exemplary shoe 10. As can be seen in this view, an adjustable inner assembly 30 is positioned within the outer shell 21 and is generally formed from two pieces 31,32 which are shaped to engage and move relative to one another in overlapping relationship. The overlapping and engaging inner assembly 30 provides a relatively rigid last board for desirable foot support. In this embodiment, rear piece 31 is partially positioned within a heel section of the shoe 10 and includes the control mechanism 41, discussed below, which allow the shoe to be adjusted in size. The shoe includes a two piece inner last board 33, 34. This two piece inner last is made from materials, e.g., cloth, used for conventional last boards and is attached or sewn to the outer shell. Over the inner last is a two piece inner sole 36 and 37 made from conventional materials, e.g., foam, and shaped to overlap one another so that the pieces slide as the shoe size is adjusted.

Figure 4A:
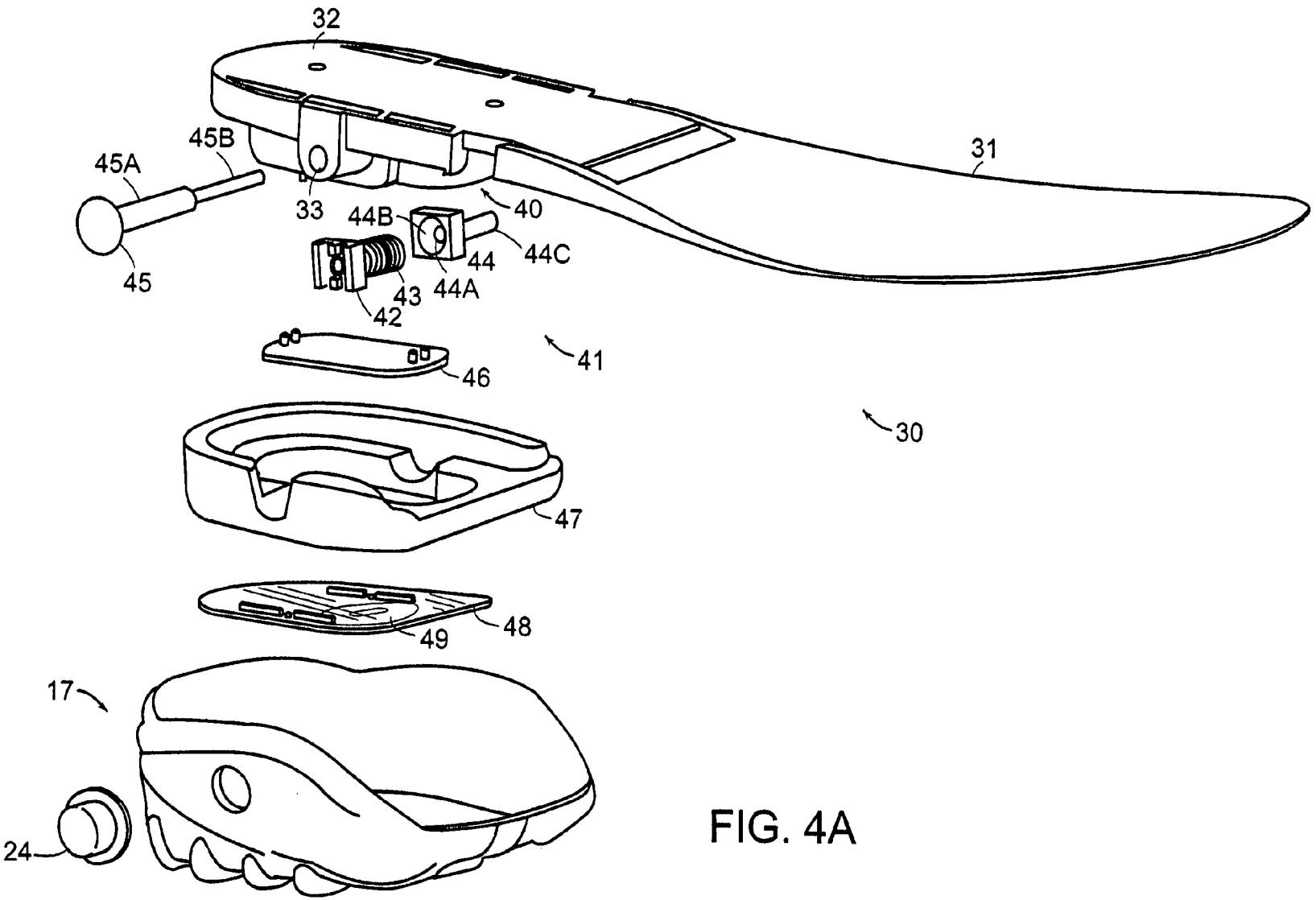
FIGS. 4A–B are exploded views of expandable last boards according to certain embodiments of the invention.

FIG. 4A is an exploded view of one embodiment of the inner assembly 30 in relation to rear outer assembly 17. The inner assembly 30 includes front last board piece 31 and rear last board piece 32 positioned in overlapping, slidable and engaging relationship, as will be described more fully below in connection with the description of other figures. The front piece includes a downward facing cavity 40 (shown better in other figures) into which a control mechanism 41 is positioned. Plate 46 is mounted on the front piece 31 over the cavity 40 and encapsulates the control mechanism within the cavity, protecting it from glue and other substances used in the construction of the entire shoe. On the bottom surface of plate 46, shoe size indicia or adjustment indicia may be printed, engraved, labeled, or the like. The heel portion of the inner assembly 30 is positioned within a heel support 47. A plate 48 having magnification window 49 is fixed to the rear piece 32 by protrusions or the like to align the window 49 with the indicia on the bottom surface of plate 46. Cap 24 is fit over the proximal end of pin 45 and the entire assembly is fit within rear outer assembly 17 and the other components of the outer shell 21.

Figure 4B:
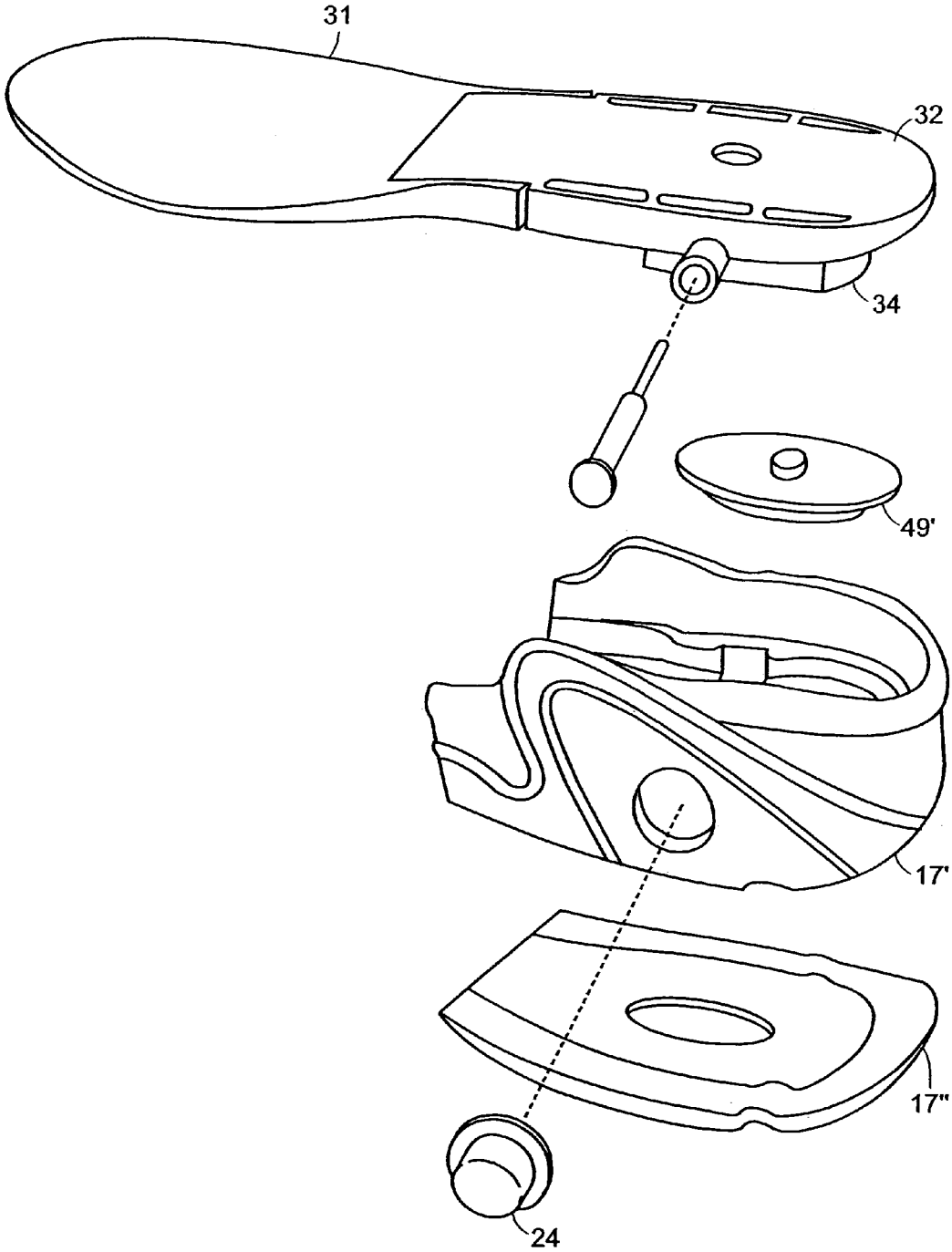

FIG. 4B is an exploded view of another embodiment of the inner assembly 30. In this embodiment, the front piece 31 has an upward facing cavity (not shown) into which the control mechanism is placed. The bottom surface of the cavity is integrated into the front piece 31 (as opposed to an attached plate 46), and the control mechanism is encapsulated by the rear piece 32 being positioned over the opening of the cavity. The bottom surface of the front piece, like the plate 46 of the prior embodiment, includes shoe size indicia or adjustment. The bottom surface 34 of the rear piece 32 has a cutout (not shown), through which the indicia may be observed. In particular, a magnification window 49' is attached to the bottom surface 34 of the rear piece 32 in alignment with the cutout and through which the indicia may be viewed. To illustrate the wide applicability of the design, this figure shows the inner assembly being used with a midsole 17' having an attached outer sole 17".

With reference to FIGS. 3, 4A, 6, and 7, the control mechanism 41 has a natural, locked state in which a toothed member 42 engages teeth 62 integrated with or attached to the front piece. The locked state prevents the front and rear pieces 31 and 32 from being moved longitudinally relative to one another. By sufficiently pushing pin 45 of the control mechanism 41 in a transverse direction relative to the last board's longitudinal direction, the last board may be placed in an unlocked state in which the toothed member 42 disengages the integrated or fixed tooth segment. Consequently, the front piece 31 may be moved longitudinally relative to the rear piece 32. The longitudinal movement is constrained by the extent of the longitudinal apertures 35, one of two of which is shown in FIG. 3. As the front and rear pieces 31, 32 are moved relative to one another, different indicia will align with the magnification window 49, 49'.

Figure 6:
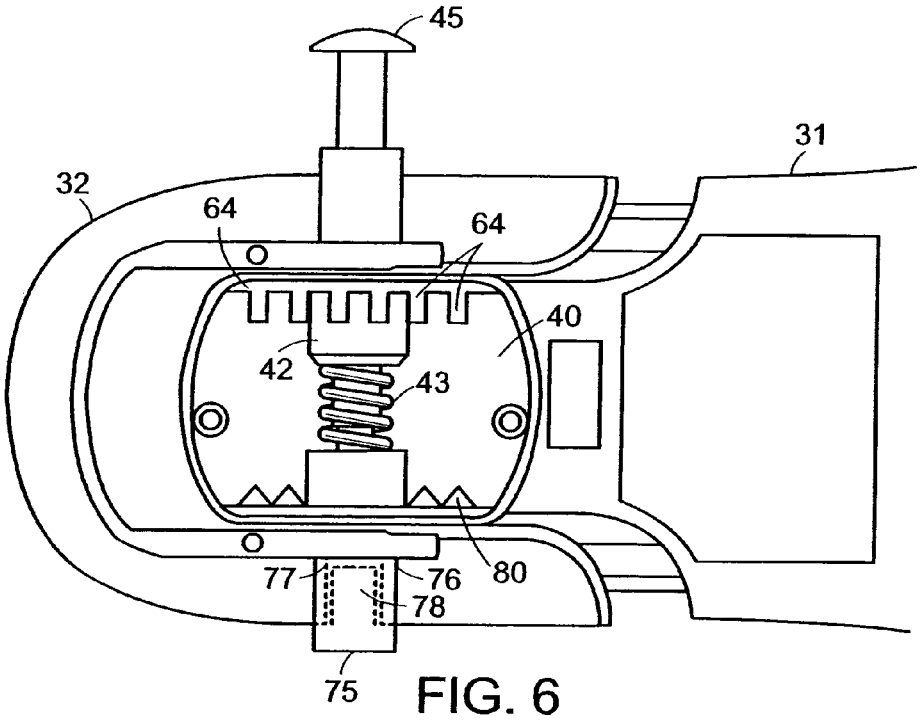
FIGS. 6 and 7 show an exemplary control mechanism in two states.

The control mechanism 41 of either embodiment includes a toothed member 42, a biasing spring 43, a support guide 44, and an urging pin 45. The teeth of the toothed member 42 are shaped and spaced to engage with teeth 62 (shown in FIGS. 6 and 7) integrated into or fixed to a wall 64 of the cavity 40 facing the teeth of the toothed member 42. FIG. 6 shows the support guide 44 and spring 43 biasing the toothed member 42 into engagement with the integrated teeth. This "locked" state prevents the front piece from moving longitudinally relative to the rear piece 32.

Figure 7:
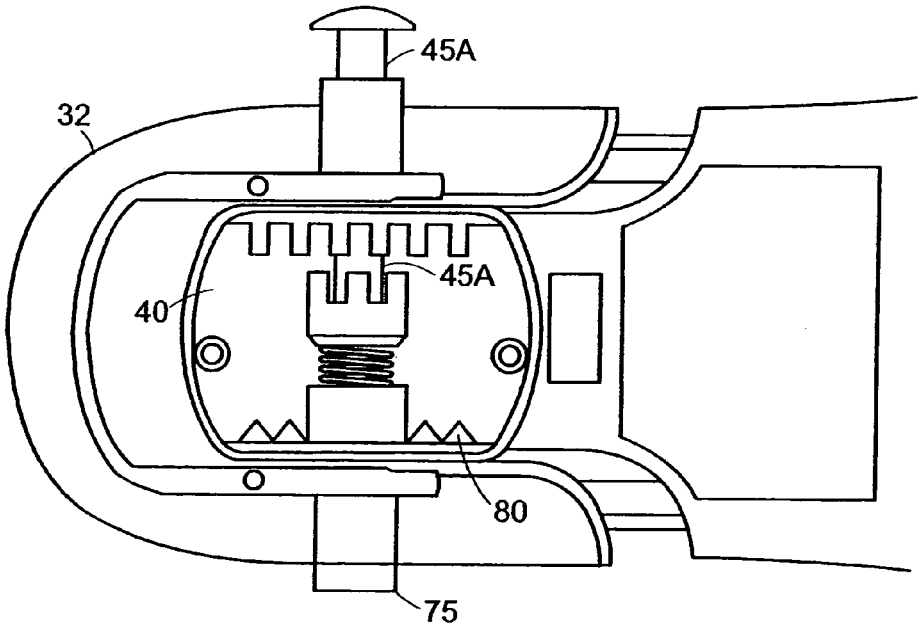

Pin 45 has a first section 45A of a relatively larger diameter and a second section 45B of a relatively smaller diameter. The pin 45 is sized to fit through aperture 33 in rear section 32, through longitudinal slot 35 (shown in FIG. 3), through the control mechanism 41, and into another aperture corresponding to aperture 33 but on the hidden side of the rear section 32. More specifically, the larger diameter section 45A fits through aperture 33 but is too large to fit through the central aperture 42A of toothed member 42. The smaller diameter section 45B, however, is small enough to fit through the central aperture 42A of member 42 and aperture 44A of support 44. The support 44 includes a circular protrusion 44C which defines the aperture 44A and which fits into the aperture corresponding to the aperture 33 but on the hidden side. Thus, as the pin 45 is pushed through the aperture 33, the larger diameter section 45A eventually contacts toothed member 42 but does not pass through it. Continued pushing of pin 45 will thus cause the toothed member 42 to move transversely and compress spring 43 against support 44. Circular recess 44B of support 44 helps keeps the components in secure alignment. Sufficient pushing of the pin 45 will cause the teeth of member 42 to clear and disengage the integrated teeth of front piece 31, as shown in FIG. 7. This "adjustment" state allows the front piece 31 to be moved longitudinally relative to the rear piece 32, while the teeth are so disengaged. The number of teeth and the spacing in between teeth may be made to index to known adjustments. For example, the amount of teeth and spacing may be made to correspond to a range of sizes 13 to 1 and allow half size increments 13, 13.5, 1.

FIG. 6 and further illustrates an end cap 75. The end cap has a cylindrical protrusion 77 to fit into aperture-defining portion 76 and defines an aperture 78 to receive a distal end of pin 45. The cap further encapsulates the control mechanism protecting it from glue and other debris during manufacturing and use of the shoe.

Though the control mechanism and states are shown and described with reference to the embodiment of FIG. 4A, the operation and components are the same for the embodiment of FIG. 4B. The embodiment of FIG. 4B requires the control mechanism (except for pin 45) to be assembled within the cavity of the front piece 31 before the front piece is arranged with the rear piece but it has the advantage of improved encapsulation and protection from glue used in shoe assembly.

Figure 5A:
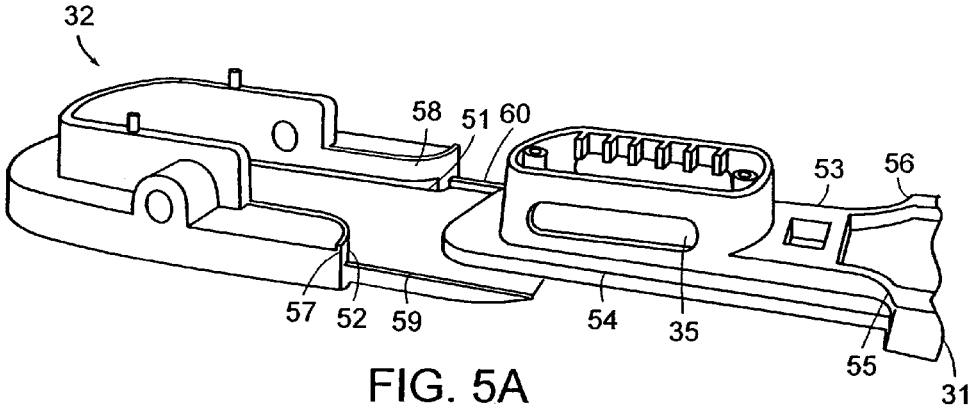
FIGS. 5A–C show features of expandable last boards according to certain embodiments of the invention.
Figure 5B:
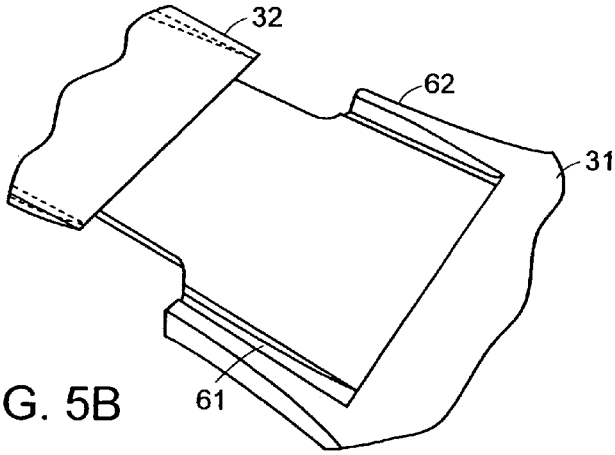
Figure 5C:
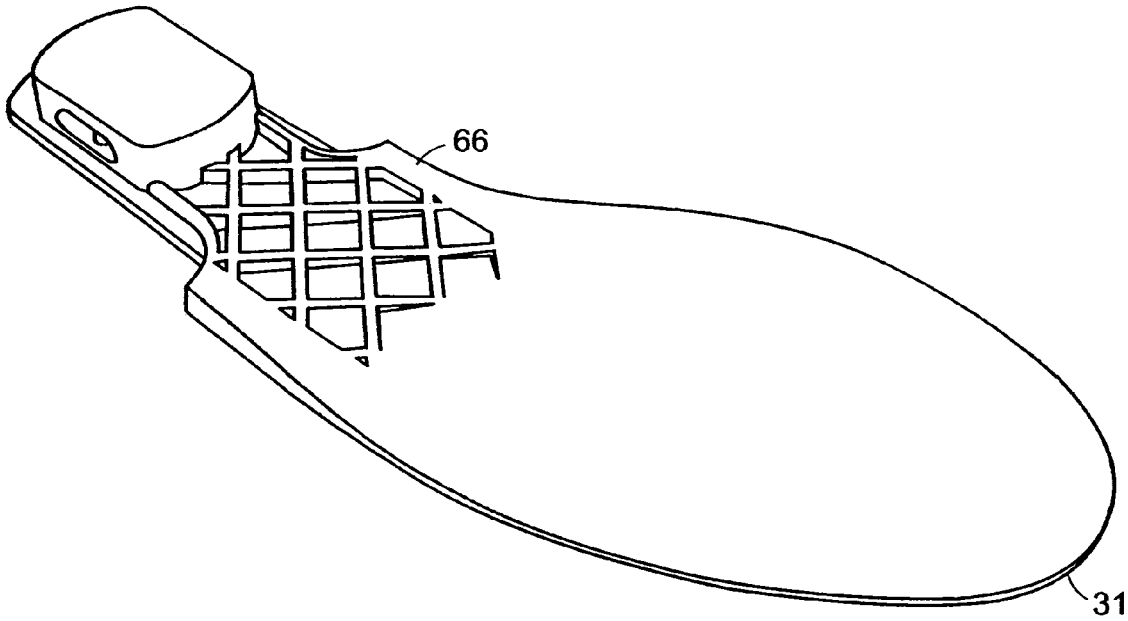

FIGS. 5A–C show certain improvements to the design of the front and rear pieces relative to embodiments shown in WO 01/33986. The rear piece 32 is generally shaped like the rear piece disclosed in WO 01/33986 having slots 51 and 52 to accept the wings 53 and 54 of the front piece 31 so that the front piece may slide within rear piece 32 in an overlapping relationship. When fully contracted curved sections 55 and 56 of the front piece 31 contact curved walls 57 and 58 of the rear piece 32. Unlike the design shown in WO 01/33986, the rear piece 32 includes two rails 59 and 60 protruding up from the major surface of the rear piece 32, and the front piece includes two slots 61 and 62 shaped to receive these rails. Because the rails protrude from the major surface they help inhibit transverse sliding of the front and rear pieces and improve the torsional rigidity of the last board 30.

Figure 8A:
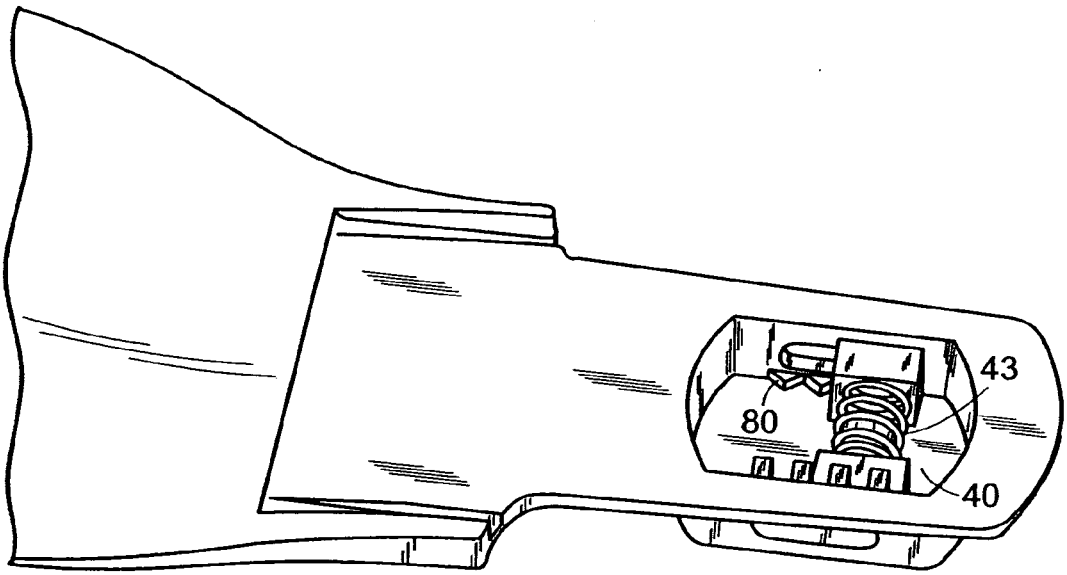
FIG. 8A shows a perspective view of last boards according to one embodiment of the invention.
Figure 8B:
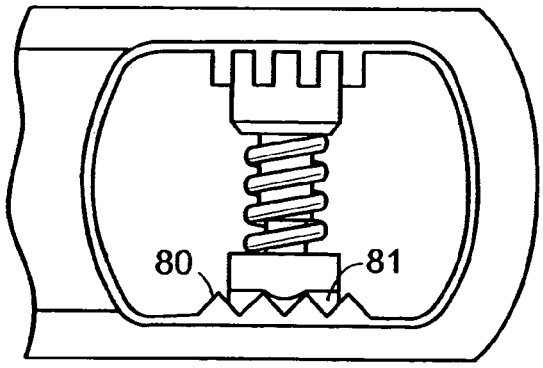
FIG. 8B shows a bottom cross section view according to one embodiment of the invention.

As shown in FIGS. 6–8, the cavity 40 has a set of notches 80 to provide ergonomic feedback (in the form of resistance and/or clicking) to the user when he or she is adjusting the shoe size. The notches are positioned to correspond to shoe size adjustments. As the front piece 31 and rear piece 32 are moved relative to one another, a surface of portion 81 of the control mechanism 41 contacts a notch, and thus provides resistance to the user pushing or pulling the two pieces 31,32 together or apart, when the teeth 64 do not align with the teeth of toothed member 42. When the teeth 64 and the toothed member 42 align, a surface of portion 81 of the control mechanism will be positioned in a valley or recess of the set of notches 80 and thus provide no resistance to the user, giving the user the tactile sensation of no resistance and signaling that the shoe size adjustment is in alignment. In addition, the surface portion 81 of the control mechanism causes a clicking sound as it completes the move from the notch into the valley or recess, further signaling to the user that the shoe size adjustment is in alignment.

FIG. 5C shows the bottom surface of front piece 31 and illustrates the lattice-shaped support structure 66 integrated into the front piece. Though other arrangements may be substituted, the structure 66 provides improved torsional rigidity in the midsole area while allowing some of the material of the front piece 31 to be removed and to thus reduce weight.

FIGS. 9–16 show additional embodiments of the invention in which the front piece 31 has one or more longitudinally extending projections which extend into a cavity (or cavities) in the sole 82. These projections help inhibit transverse sliding of the front piece 31 and rear piece 32 and improve the torsional rigidity of the last board.

Figure 9:
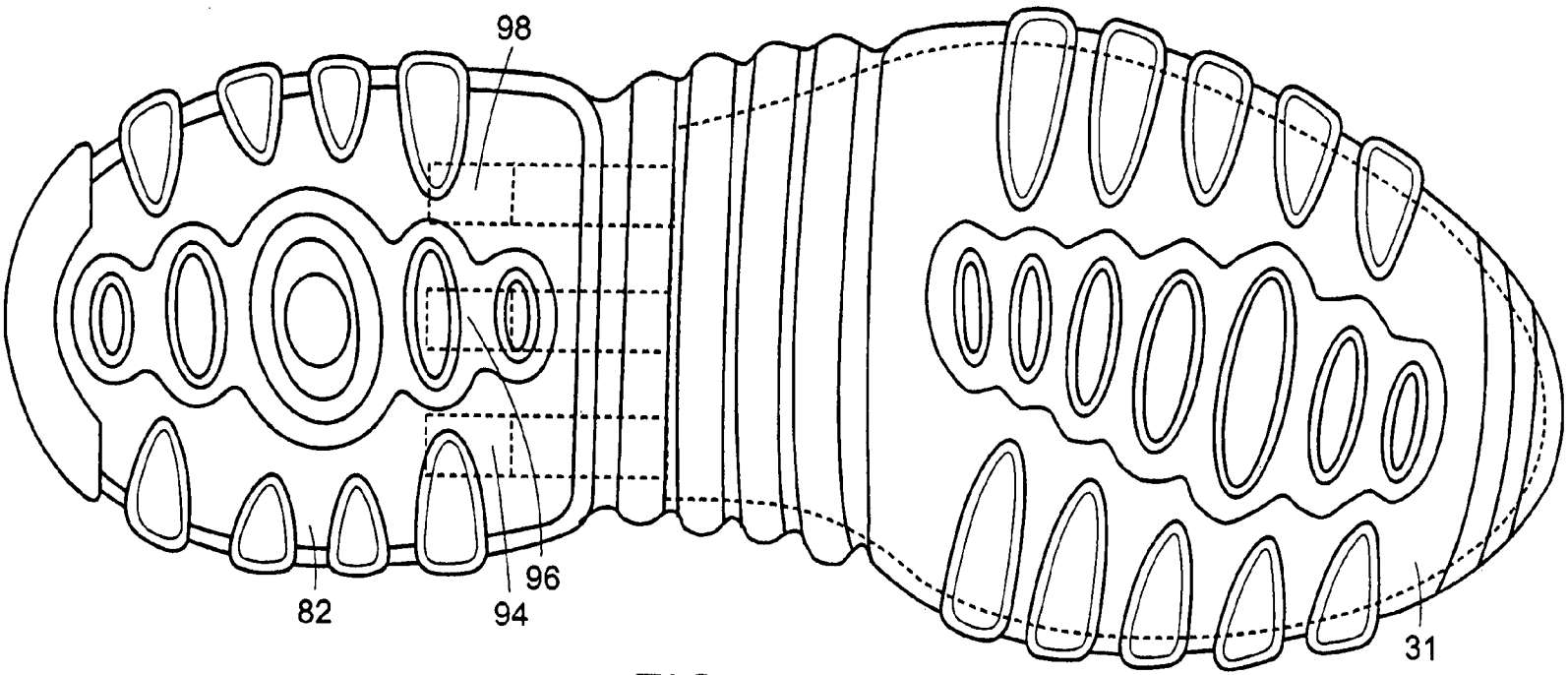
FIGS. 9–16, 18 and 20 show bottom views according to certain embodiments of the invention.
Figure 10:
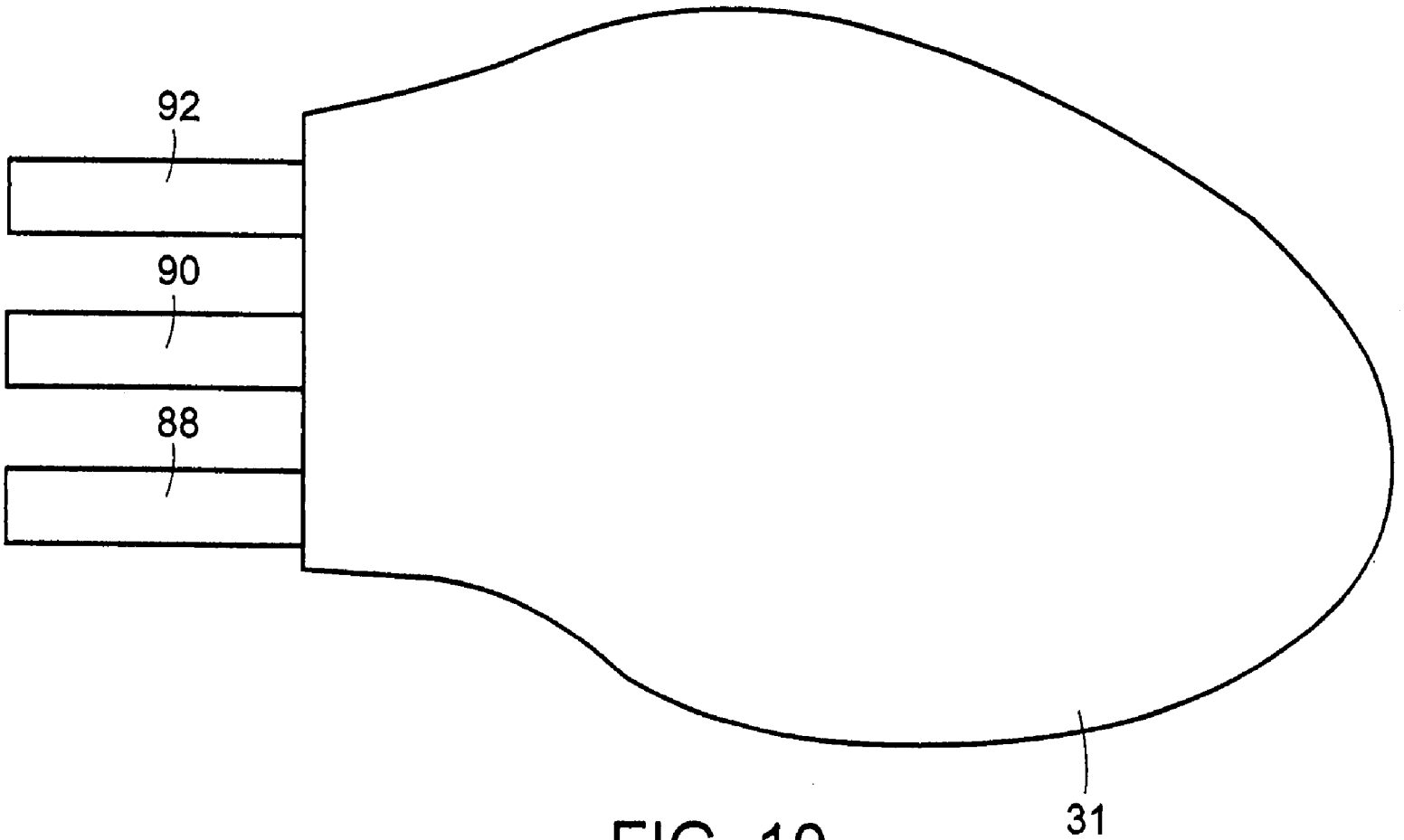
Figure 11:
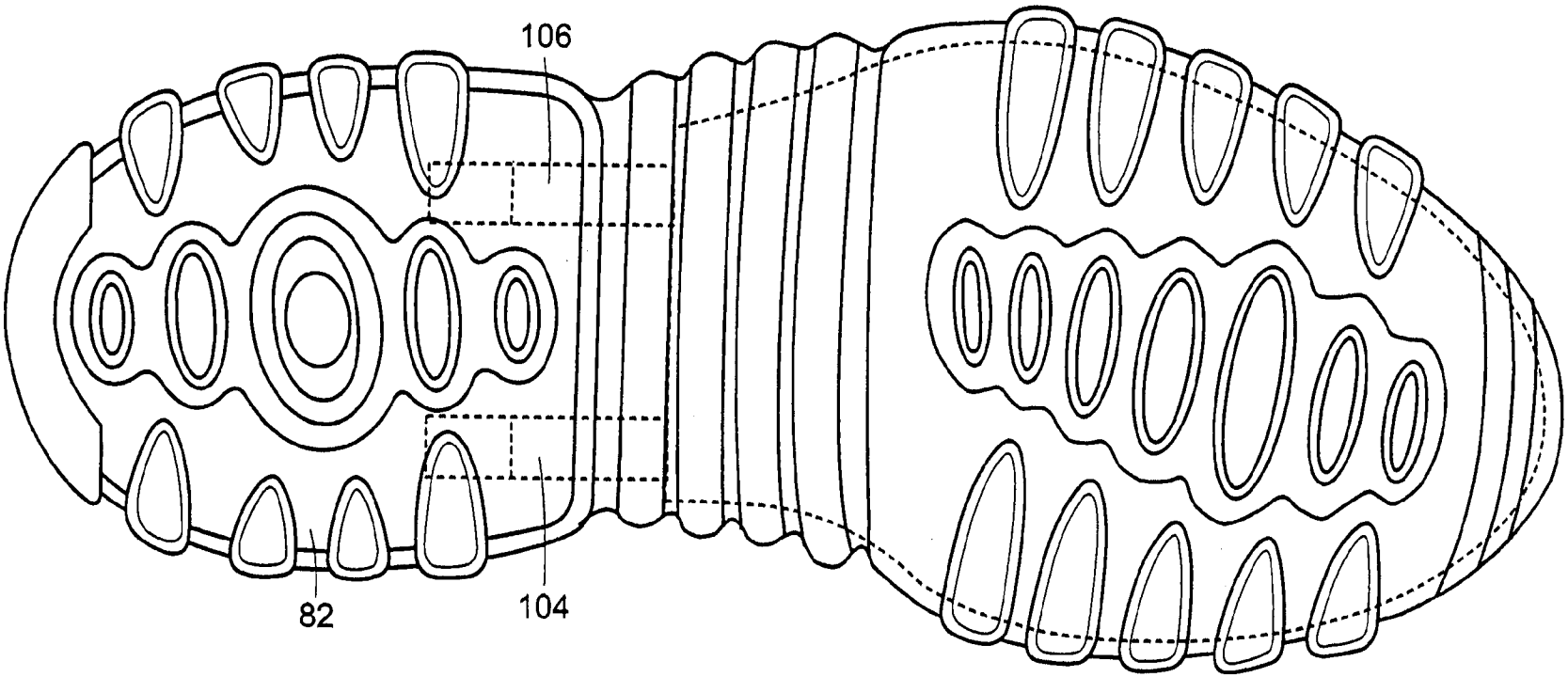
Figure 12:
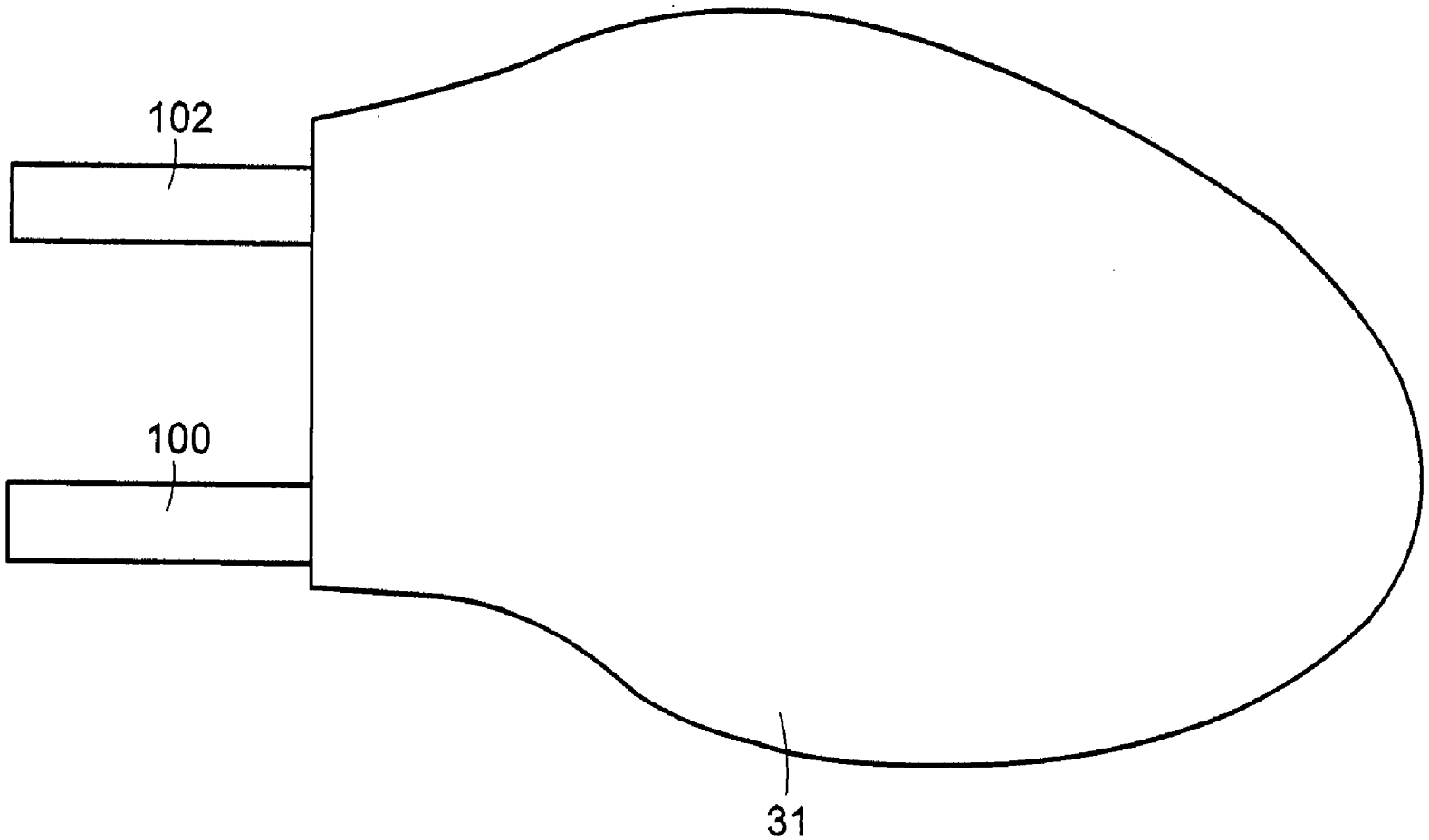
Figure 13:
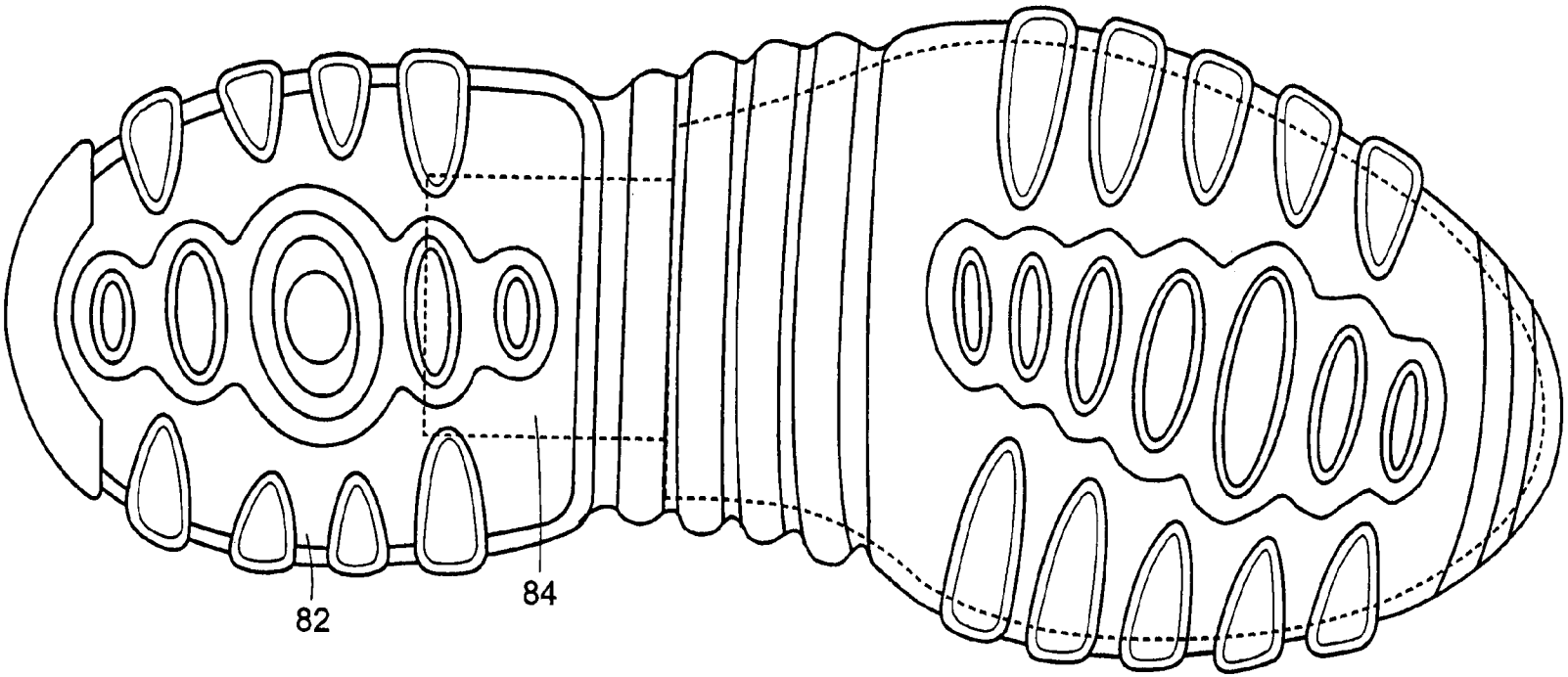
Figure 14:
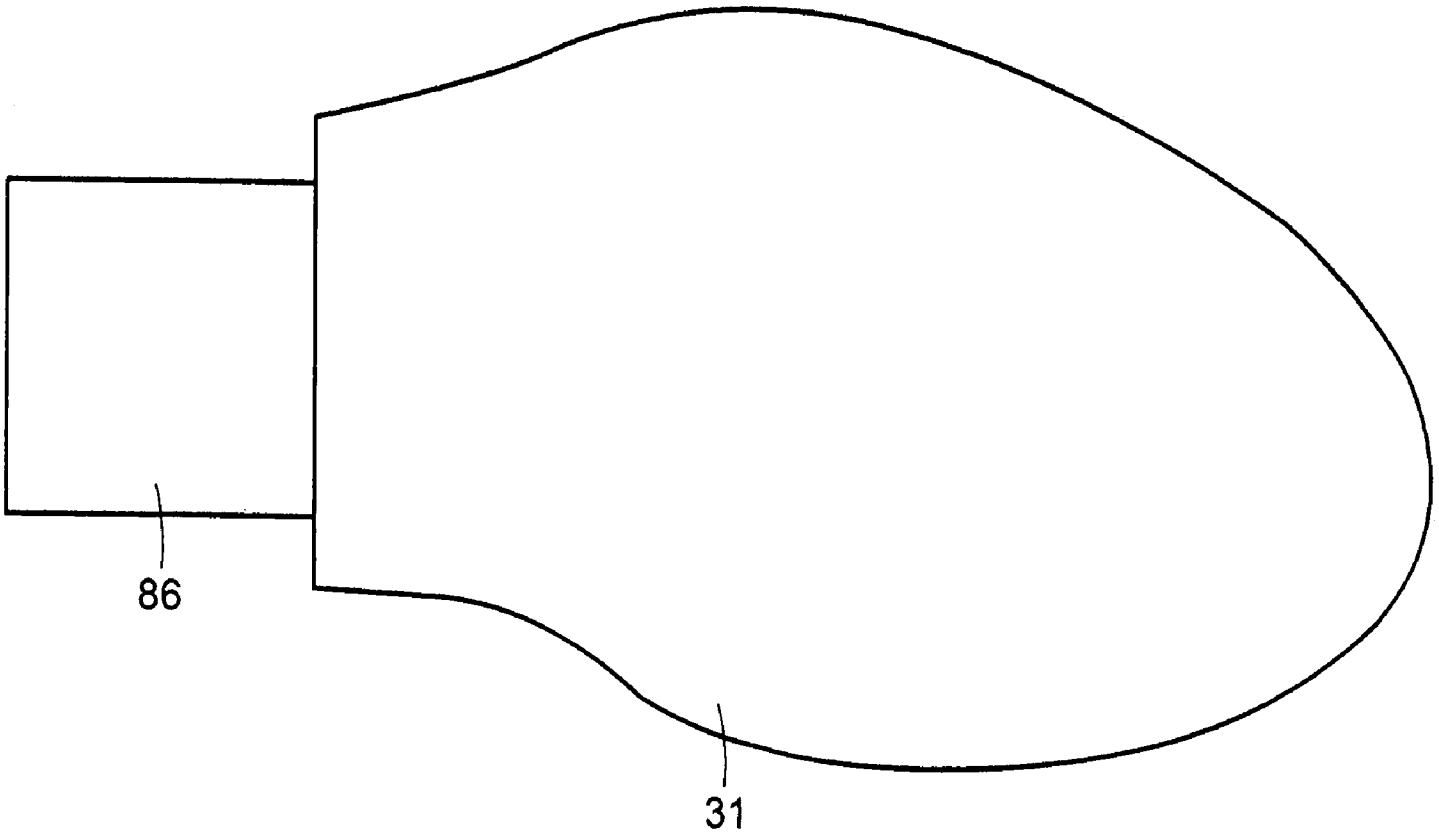
Figure 15:
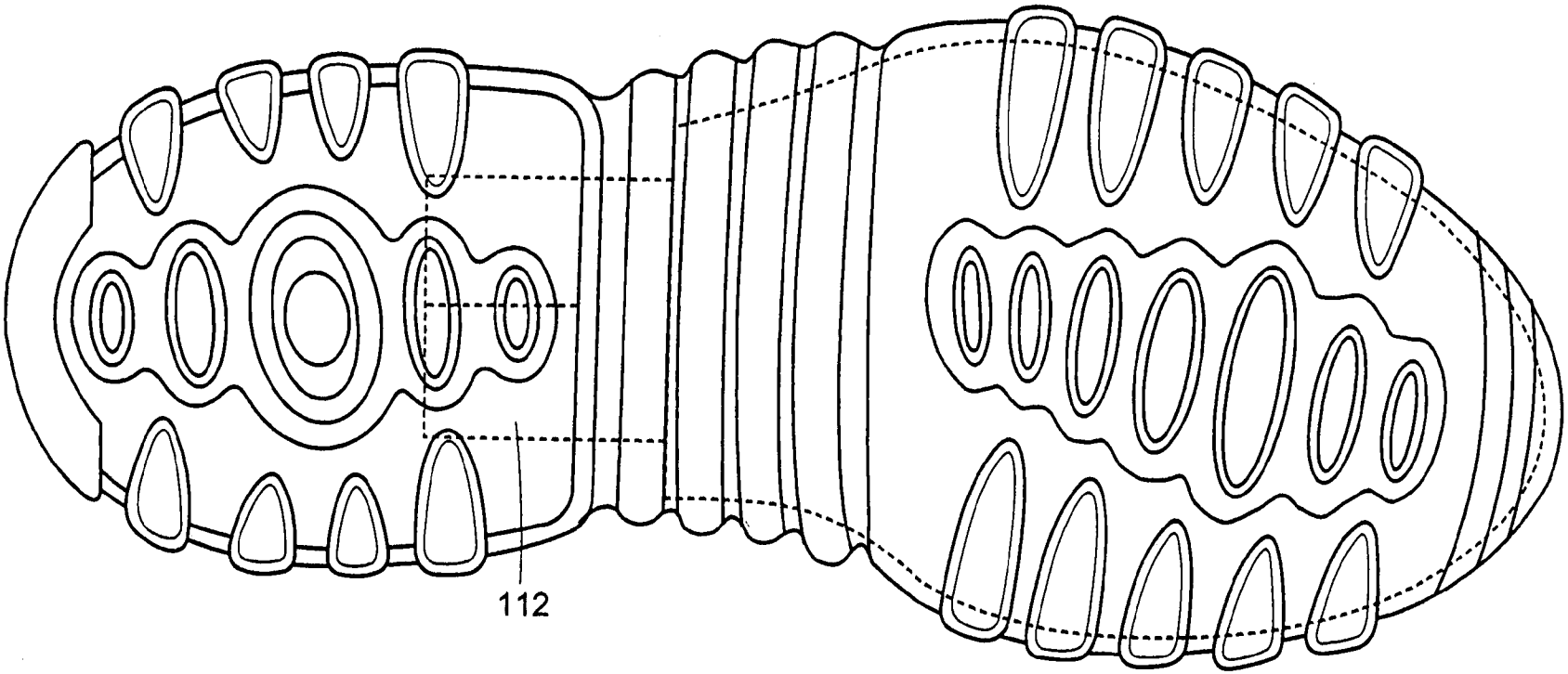
Figure 16:
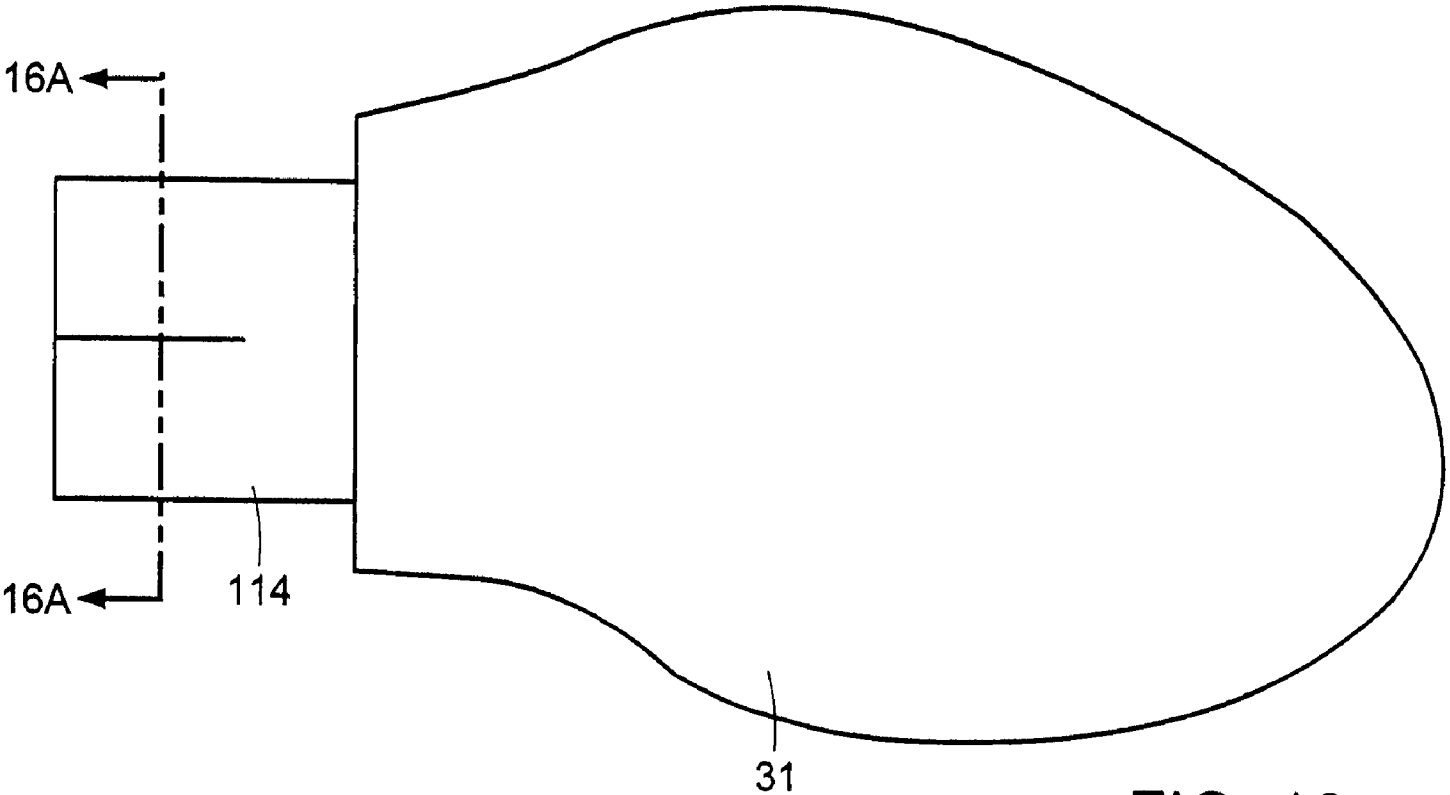
Figure 16A:
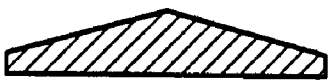

In the embodiment shown in FIGS. 9 and 10, three cylindrical rods 88, 90 and 92 extend from the front piece 31 and are positioned in corresponding cylindrical cavities 94, 96 and 98 in the sole 82. As the front piece 31 is moved relative to the rear piece 32, the cylindrical rods 88, 90 and 92 move further into the cavities 94, 96 and 98. In the embodiment shown in FIGS. 11 and 12, two cylindrical rods 100 and 102 extend from the front piece 31 and are positioned in corresponding cylindrical cavities 104 and 106 in the sole 82. In the embodiment shown in FIGS. 13 and 14, a longitudinally extending rectangular projection 86 extends from the front piece 31 and is positioned in a rectangular cavity 84 in the sole 82. In the embodiment shown in FIGS. 15 and 16, a triangular projection 112 extends from the front piece 31 and is positioned in a triangular cavity 114 in the sole 82. A cross section of the triangular projection is shown in FIG. 16A.

It is understood that projections and cavities of other shapes may be used to provide the desired torsional stability, and that the number of such projections and corresponding cavities may also be varied.

Figure 17:
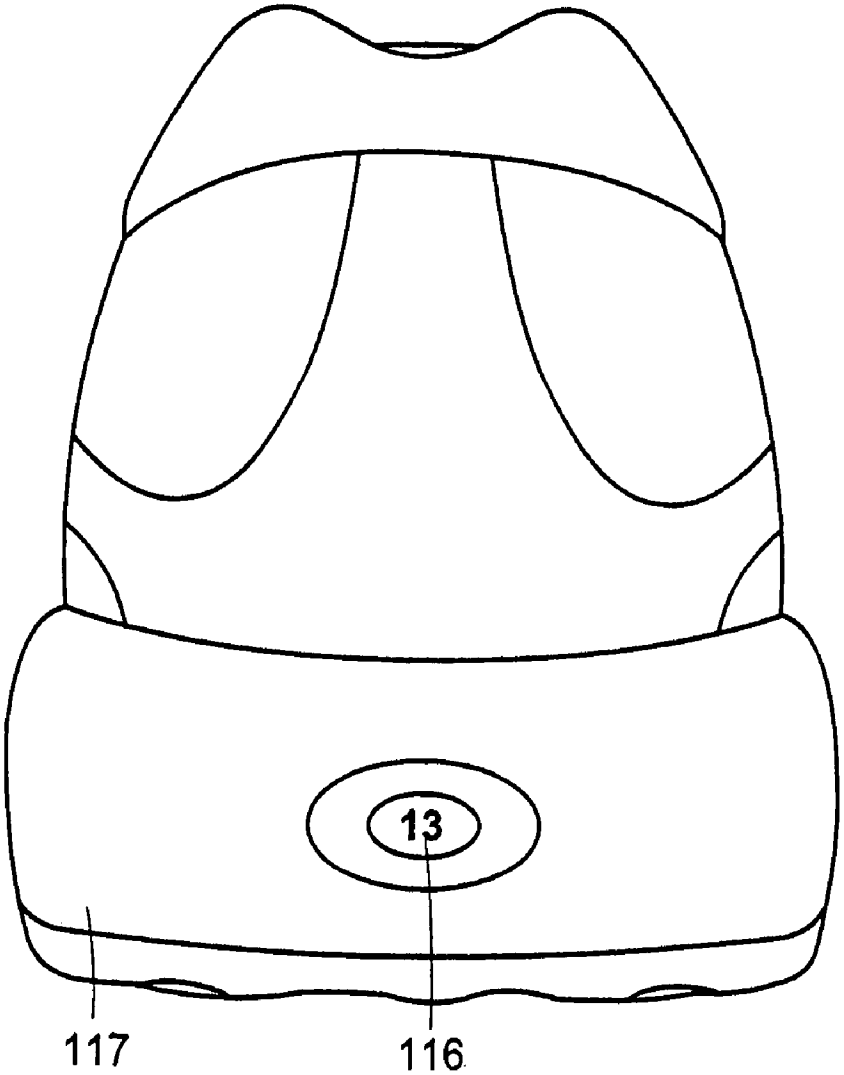
FIG. 17 shows a rear view of a shoe according to one embodiment of the invention.
Figure 18:
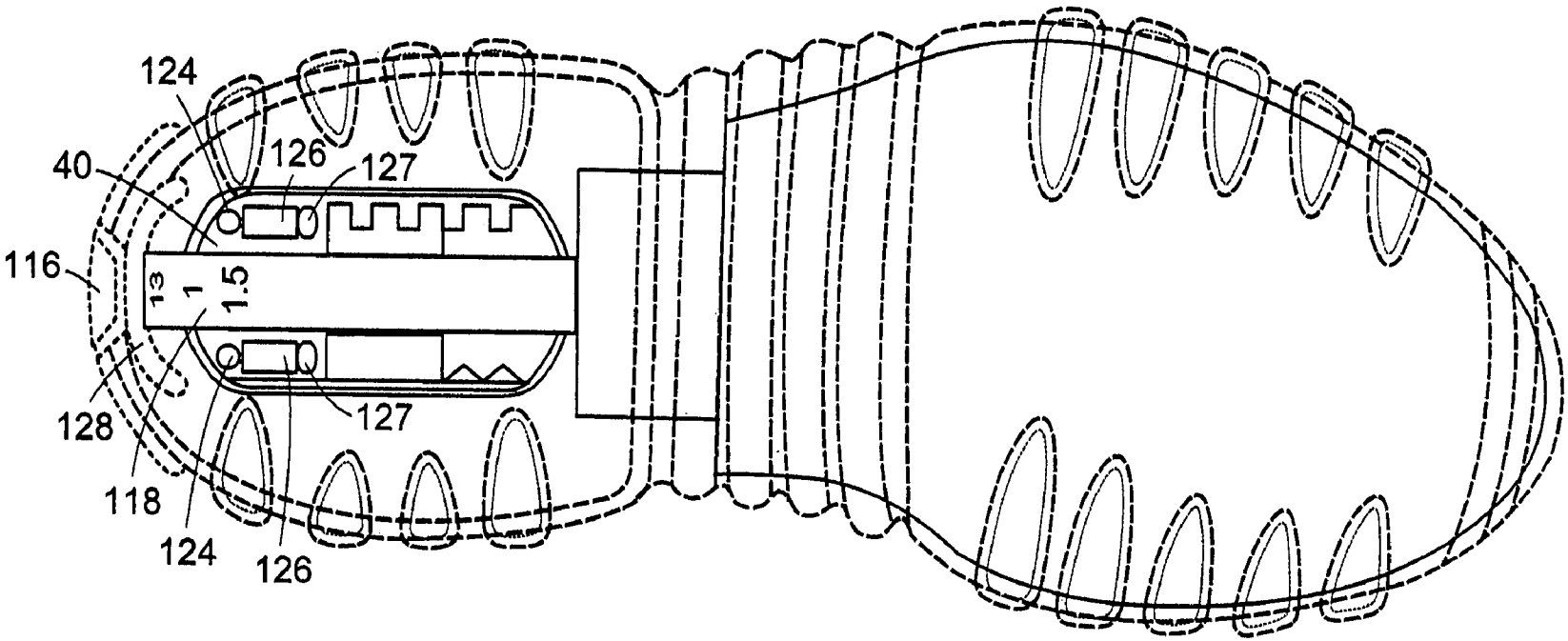

In the embodiment shown in FIGS. 17 and 18, a visualization window 116 is provided in a wall of the sole 117 in the heel portion of the shoe to provide a view to the inner assembly. As shown in FIG. 18, indicia 118, such as shoe size or adjustment indicia, is applied to the front board portion 31 so that as the front board portion 31 is moved relative to the rear board portion 32, the indicia travels up around the heel portion of the front board portion 31, and the shoe size or adjustment indicia is visible through the visualization window 116.

Figure 19:
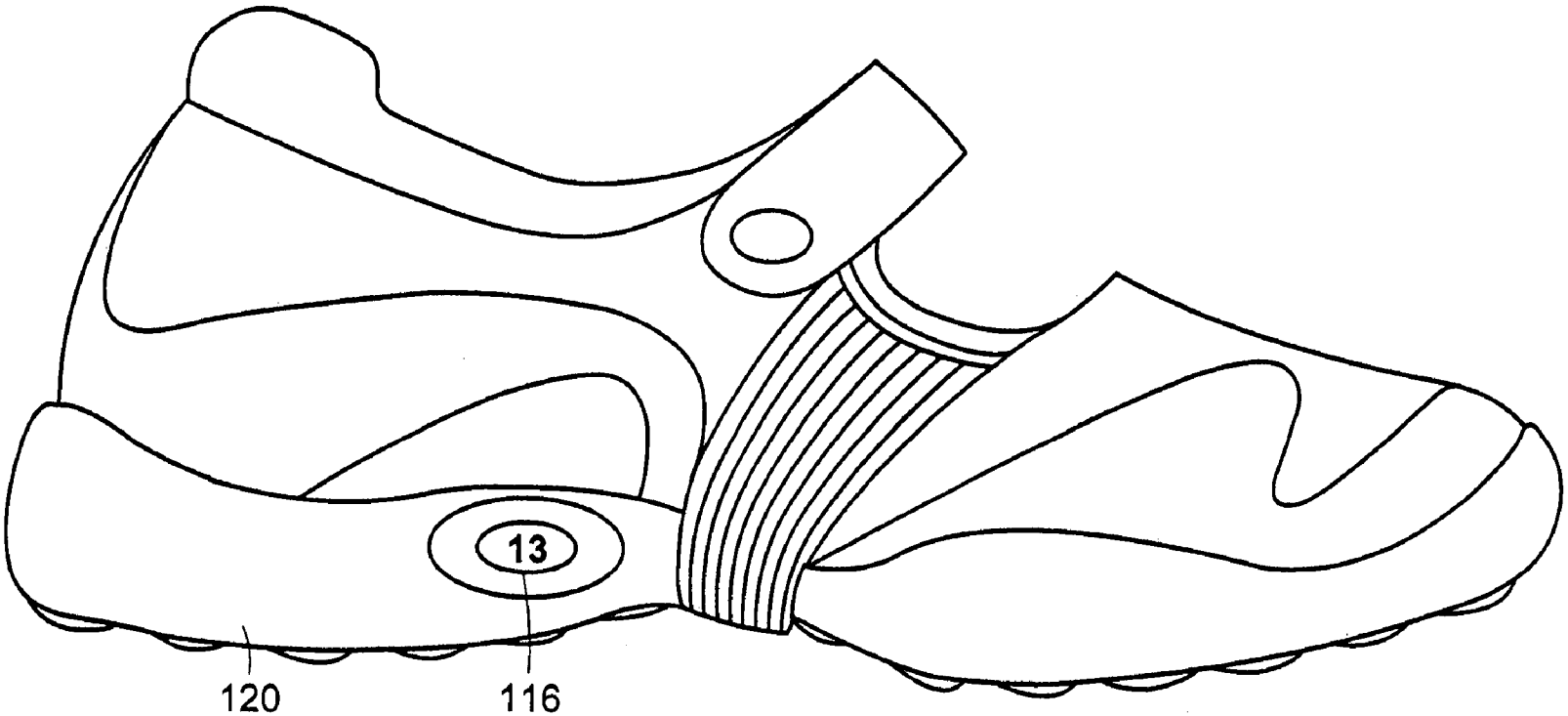
FIG. 19 shows a side view of a shoe according to one embodiment of the invention.
Figure 20:
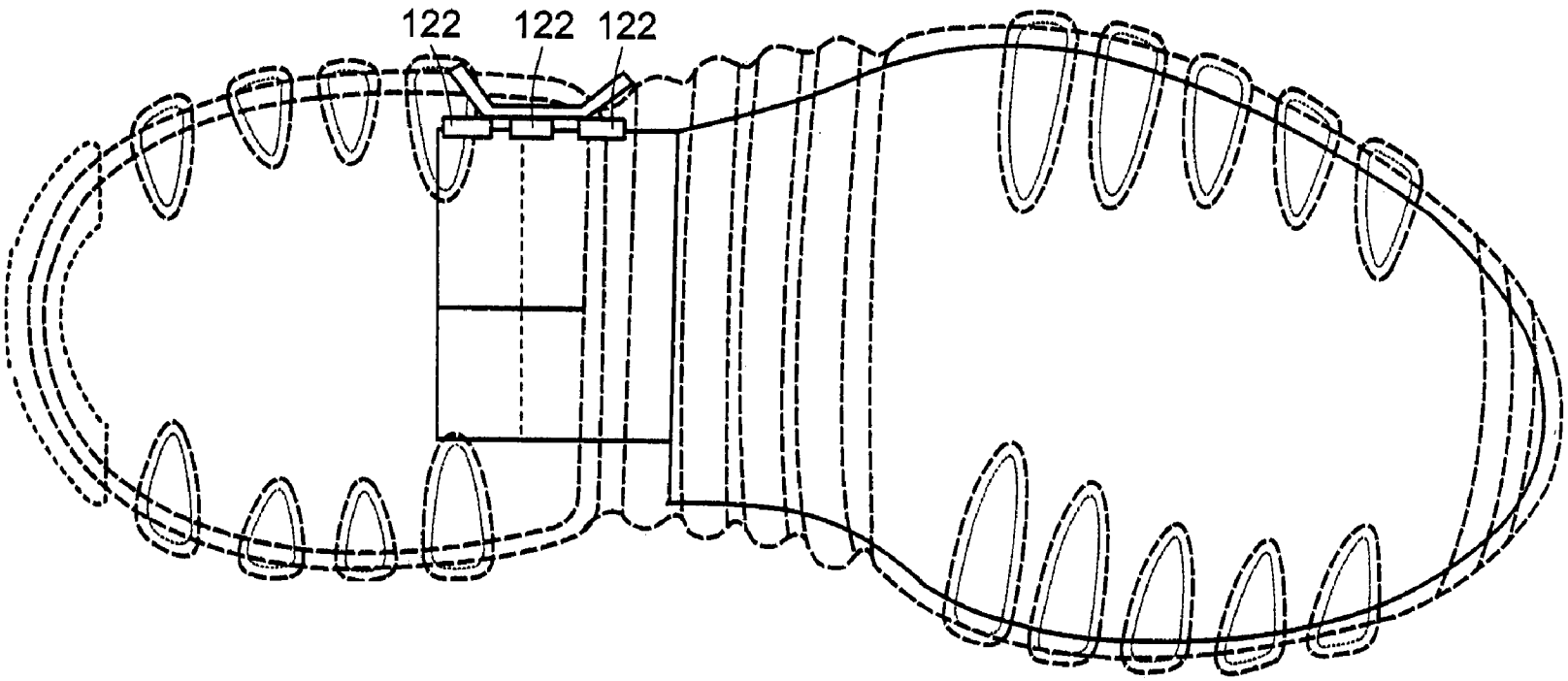

In the embodiment shown in FIGS. 19 and 20, the visualization window 116 is located in a side wall 120 of the sole of the shoe. As shown in FIG. 20, shoe size or adjustment indicia is applied to a side portion 122 of the front board portion 31 so that as the front board portion 31 is moved relative to the rear board portion 32, the shoe size or adjustment indicia is visible through the visualization window 116.

In the embodiment shown in FIG. 18, the visualization window may be illuminated. The cavity 40 includes a light source 124, electronic connectors 126 connected to a power source 127 and a clear lens 128 to transmit light from the light source 116 to the visualization window 116. The light source 124 is activated when the control mechanism 41 in the "adjustment" state as described above (i.e., where the front piece 31 is allowed to move longitudinally relative to the rear piece 32, while the teeth of member 42 are disengaged from the integrated teeth of front piece 31). The light source is de-activated when the control mechanism is in a locked state (i.e., when the teeth of member 42 are engaged with the integrated teeth of front piece 31. One way to activate the light source is to put contacts on the control mechanism, so that as the control mechanism is depressed, a circuit is formed to activate the light source so that light is transmitted from the light source to the visualization window.

The shoe designs of FIGS. 1 and 2 are exemplary. The principles of the invention may be manifested in embodiments including running shoes, biking shoes, ski boots, dress shoes, snow boarding boots, sandals and the like. Depending on the shoe type, the inner assembly may be in the form of a last board, or a combination of a last board and a midsole, or a midsole. Likewise, depending on the shoe type, the materials used will be selected to provide a desired amount of flexibility or rigidity. Moreover, depending on the shoe design the outer shell may differ. In the case of a sandal, for example, the outer shell would only have strapping. Other embodiments, such as a biking shoe, might have either netting, meshing, or no material where the bellows are shown, thus providing increased ventilation.

Moreover, the above embodiments described a flexible segment made of a bellows-shaped material, but other embodiments may use other materials, e.g., stretchable nylon, netting or meshing, or it may be omitted. Likewise all of the control features described had external features to activate the control, but other embodiment (e.g., cost-reducing embodiments or embodiments where hiding the control is desirable) may place the control mechanisms on the interior of the outer shell.

While the invention has been described in connection with certain preferred embodiments, it will be understood that it is not intended to limit the invention to those particular embodiments. On the contrary, it is intended to cover all alternatives, modifications and equivalents as may be included in the appended claims. Some specific components, figures and types of materials are mentioned, but it is to be understood that such component values, dimensions and types of materials are, however, given as examples only and are not intended to limit the scope of this invention in any manner.

What is claimed is:

1. An expandable shoe, comprising:

an outer shell shaped to conform to the foot of a user comprising a first outer assembly;

a second outer assembly;

an adjustable sole, secured to the outer shell comprising a first sole portion and a second sole portion in overlapping engagement with each other;

a locking mechanism shaped to engage and restrain in a longitudinal direction at least one of the first and second sole portions;

a biasing mechanism to bias the locking mechanism into engagement with the at least one of the first and second sole portions; and an urging member having a proximal portion external to the outer shell and positioned and movable to contact and move the locking mechanism out of engagement with the at least one of the first and second sole portions.

2. The shoe of claim 1, wherein the at least one of the first and second sole portions includes registration surfaces periodically spaced in the longitudinal direction, and wherein the locking mechanism includes at least one tooth extending transversely and positionable in engagement with one of the registration surfaces to prevent motion thereof relative to the registration surfaces.

3. The shoe of claim 1, wherein the registration surfaces are spaced apart to correspond to half size increments of longitudinal shoe size.

4. The shoe of claim 1, wherein the registration surfaces extend transversely.

5. The shoe of claim 4, wherein the registration surfaces comprise surfaces of a plurality of transversely extending teeth.

6. The shoe of claim 5, wherein the plurality of transversely extending teeth are rectangular.

7. The shoe of claim 1, wherein the urging member includes a rod portion having at least two diameters and wherein the locking mechanism includes an aperture in alignment with the rod portion and wherein the cross section of the aperture is larger than the smaller of the at least two diameters but smaller than the larger of the at least two diameters so that when the urging member is moved the rod portion contacts and moves the locking mechanism with the larger of the two diameters.

8. The shoe of claim 7, wherein the biasing mechanism includes a spring and a support structure for the spring, the support structure having an aperture in alignment with the interior of the spring and with the rod portion of the urging member, the aperture of the support structure being larger than the smaller of the at least two diameters of the rod portion.

9. The shoe of claim 1, wherein one of the first and second sole portions includes a cavity containing the locking mechanism, the cavity defining an upwardly facing opening covered by the other of the first and second sole portions when the first and second sole portions overlap.

10. The shoe of claim 1, wherein one of the first and second sole portions includes at least one groove extending longitudinally and wherein the other of the first and second sole portions includes a corresponding rail in alignment with the groove and that is positioned within the groove as the first and second sole portions overlap.

11. The shoe of claim 1, wherein at least one of the first and second sole portions includes a lattice support structure.

12. The shoe of claim 1, further comprising an expandable segment attached to the first and rear second assemblies to define a shoe outer shell wherein the expandable segment extends at least partially along each side of the outer shell and transversely across the bottom of the outer shell.

13. The shoe of claim 12, wherein the expandable segment is shaped as a bellows.

14. An expandable shoe, comprising:

an outer shell shaped to conform to the foot of a user comprising a first outer assembly;

a second outer assembly;

an adjustable sole secured to the outer shell comprising a first sole portion secured to the first outer assembly and comprising a plurality of registration members secured thereto spaced apart longitudinally a second sole portion secured to the second outer assembly, the second sole portion having a guide formed therein a locking mechanism shaped to engage the registration members to prevent longitudinal motion thereof, the locking mechanism slidably positioned within the guide to be movable in a transverse direction in and out of engagement with the registration members;

a biasing mechanism to bias the locking mechanism into engagement with the registration members; and an urging member having a proximal portion external to the outer shell and positioned and movable to contact and move the locking mechanism out of engagement with the registration members.

15. The expandable shoe of claim 14, wherein the registration members comprise transversely extending surfaces and wherein the locking member comprises at least one transversely extending tooth selectively positionable in engagement with the transversely extending surfaces.

16. The expandable shoe of claim 15, wherein the registration members comprise a plurality of transversely extending teeth.

17. The expandable shoe of claim 16, wherein the teeth are rectangular.

18. The expandable shoe of claim 14, wherein the guide comprises a transversely extending aperture formed in the second sole portion.

19. The expandable shoe of claim 14, wherein the second sole portion comprises a longitudinal groove and wherein the first sole portion comprises at least one flange positionable within the groove, the groove restraining the flange against vertical and transverse movement when engaged therewith.

20. The shoe of claim 14, further comprising an expandable segment attached to the first and rear second outer assemblies to define a shoe outer shell wherein the expandable segment extends at least partially along each side of the outer shell and transversely across the bottom of the outer shell.

21. The shoe of claim 20, wherein the expandable segment is shaped as a bellows.

* * * * *

UNITED STATES PATENT AND TRADEMARK OFFICE

CERTIFICATE OF CORRECTION

PATENT NO. : 7,137,212 B2
APPLICATION NO. : 10/846747
DATED : November 21, 2006
INVENTOR(S) : Miller et al.

It is certified that error appears in the above-identified patent and that said Letters Patent is hereby corrected as shown below:

Title Page, Item (75)
Inventor: Kwong Dong Chil should be spelled --KWON DONG CHIL--

Title Page, Item (60)

Related U.S. Application Data:

Patent No. 6,574,888 should read as --a continuation-in-part of Patent No. 6,438,872.--

Signed and Sealed this

Twentieth Day of February, 2007

JON W. DUDAS
*Director of the United States Patent and Trademark Office*